US005622255A

United States Patent [19]

Riccoboni

[11] Patent Number: 5,622,255

[45] Date of Patent: Apr. 22, 1997

[54] PORTFOLIO-STYLE GARMENT BAG

[75] Inventor: Gene J. Riccoboni, Carmel, N.Y.

[73] Assignee: Ricco International, Brewster, N.Y.

[21] Appl. No.: 397,505

[22] Filed: Mar. 1, 1995

Related U.S. Application Data

[63] Continuation-in-part of Ser. No. 153,394, Nov. 16, 1993, abandoned, which is a continuation-in-part of Ser. No. 57,100, May 3, 1993, abandoned.

[51] Int. Cl.[6] ..... B65D 85/18

[52] U.S. Cl. ..... 206/279; 223/94

[58] Field of Search ..... 223/89, 90, 94; 206/279, 287.1

[56] References Cited

U.S. PATENT DOCUMENTS

| | | | |
|---|---|---|---|
| 1,052,426 | 2/1913 | Ringler | 223/94 X |
| 1,253,608 | 1/1918 | Lambert | 223/94 X |
| 1,258,476 | 3/1918 | Severance | 223/89 |
| 1,807,267 | 5/1931 | Winship | 223/94 |
| 1,866,150 | 7/1932 | Books | 223/94 |
| 2,080,645 | 5/1937 | Wheary . | |
| 2,526,142 | 10/1950 | Koch . | |
| 2,856,110 | 10/1958 | Cowan | 223/89 |
| 3,115,959 | 12/1963 | Jaffe . | |
| 3,221,848 | 12/1965 | O'Neil . | |
| 3,557,944 | 1/1971 | Crane . | |
| 3,811,543 | 5/1974 | Parrochia . | |
| 4,126,252 | 11/1978 | Wasserman | 223/94 X |
| 4,158,406 | 6/1979 | Feder . | |
| 4,693,367 | 9/1987 | Mathieu . | |
| 4,753,342 | 6/1988 | Pulichino, Jr. et al. . | |
| 4,782,947 | 11/1988 | Sheiman . | |
| 4,825,985 | 5/1989 | Kim . | |
| 4,880,089 | 11/1989 | Chombert et al. . | |
| 4,887,700 | 12/1989 | Rice . | |
| 4,898,274 | 2/1990 | Stout et al. . | |
| 4,901,897 | 2/1990 | Briggs et al. . | |
| 4,905,877 | 3/1990 | Gatling . | |
| 4,932,571 | 6/1990 | Blanchard | 223/89 |
| 4,948,019 | 8/1990 | Rodum . | |
| 4,951,816 | 8/1990 | Smith . | |
| 4,988,021 | 1/1991 | Adams et al. . | |
| 5,007,562 | 4/1991 | Brink et al. . | |
| 5,044,534 | 9/1991 | Hwang . | |
| 5,065,915 | 11/1991 | Rösch . | |
| 5,085,357 | 2/1992 | Chen . | |
| 5,183,190 | 2/1993 | Zuckerman . | |
| 5,460,302 | 10/1995 | Foraker | 223/89 X |

FOREIGN PATENT DOCUMENTS

| | | | |
|---|---|---|---|
| 72962 | 9/1960 | France | 223/94 |

*Primary Examiner*—Allan N. Shoap
*Assistant Examiner*—Christopher J. McDonald
*Attorney, Agent, or Firm*—Pennie & Edmonds

[57] ABSTRACT

An improved garment-bag and hanger, used by travelers to organize, store, secure, and transport garments between various locations. The "SuitFolio" is a portfolio for either suits or dresses, resembling an artist's portfolio in design and function. The overall book-like concept for the "SuitFolio" enables each garment to be stored and accessed on one single 'Page' in a manner similar to that which an artist would store and present their artwork via their portfolio. The uniqueness of the "SuitFolio" lies in its innovative, built-in hanger-system, which floats freely within a page-like covering, and is attached to the inside shell of the "SuitFolio" by means of spiral binding; thus enabling each 'Page' to turn without complication. In addition, garments stored and transported within the "SuitFolio" are folded in a longitudinal manner, unlike conventional garment-bags, which fold garments in the unnatural, latitudinal fashion; thereby facilitating undesirable wrinkling of such garments.

5 Claims, 8 Drawing Sheets

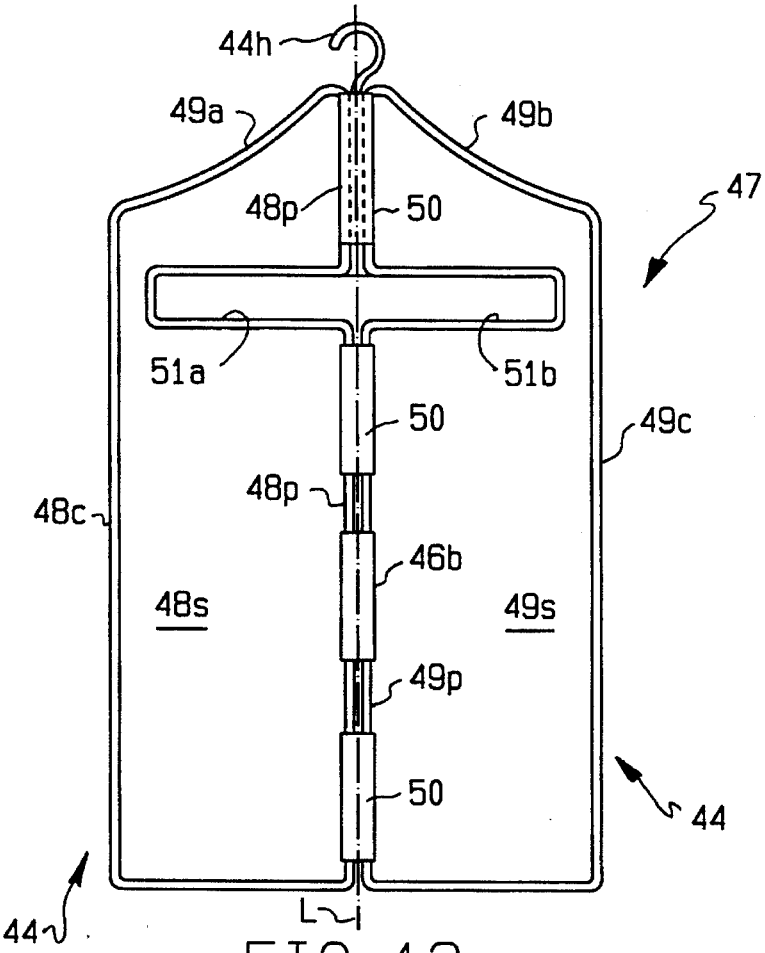
FIG. 12
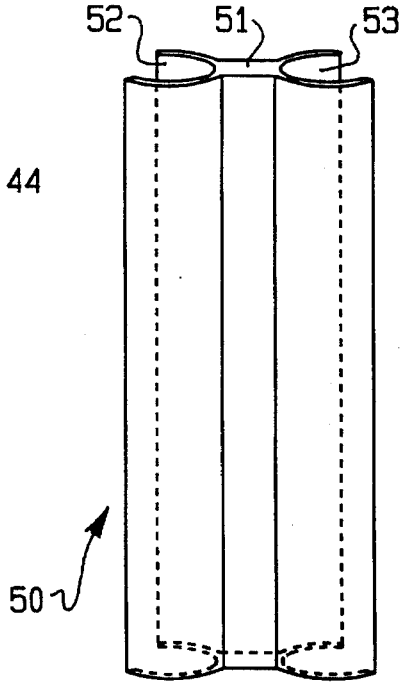
FIG. 13
FIG. 14
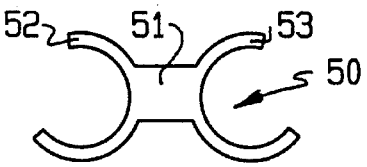
FIG. 15
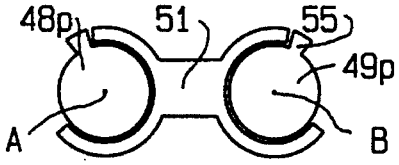
FIG. 16
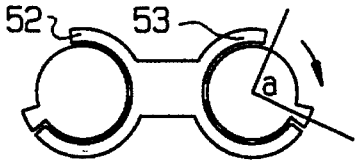

PORTFOLIO-STYLE GARMENT BAG

RELATED APPLICATIONS

This application is a continuation-in-part of U.S. patent application Ser. No. 08/153,394 filed Nov. 16, 1993, now abandoned, which in turn is a continuation-in-part of U.S. patent application Ser. No. 08/057,100 filed May 3, 1993, now abandoned, entitled "Portfolio-Style Garment Bags for Suits.

BACKGROUND

1. Field of Invention

This invention relates to a new concept for a Garment-Bag, specifically to an improvement made to those used by travelers to carry their suits or dresses.

2. Description of Prior Art

For the person who must constantly make short trips between various locations, the common garment-bag assists in carrying suits in an economical manner.

All existing garment-style bags employ the standard fold at the mid-section (latitudinal), which results in a square carry-shape. The problem with folding suits in this bent-over manner, is that the suit inevitably will wrinkle, since the natural creases in the garment run along the longitude of the suit. An example of the traditional style, garment-bag is U.S. Pat. No. 3,811,543 (1973) to Parrochia, whereby the focus relates to maximizing space for multiple garments. U.S. Pat. No. 4,825,985 (1988) to Kim, also concentrates upon the compartmentalization of the garment-bag, as a means to achieve the maximum amount of clothing within the garment bag. Once again, U.S. Pat. No. 4,887,700 to Rice (1989), is an example of a design modification to the standard garment-bag.

One of the few attempts to transport suits/dresses with their shape maintained, is exhibited by U.S. Pat. No. 4,880,089 to Chombert (1989). This design simply consisted of an upright box, with slots, whereby each slot held an article of clothing. Unfortunately, the bulkiness and size of such a box, rendered air-travel with this box, impossible. In addition, this oversized box, could hardly be considered as an economical means of transport for the ordinary traveler; who needs to store their carry-on luggage in the overhead compartment of an aircraft.

Therefore, all garment-bags heretofore known, suffer from a number of disadvantages:

(a) When suits are packed in ordinary garment-bags, the suit-jacket wrinkles in a horizontal (latitudinal) manner, since the natural seams for suits, run in a longitudinal (top-to-bottom) manner.

(b) The bulkiness and size of ordinary, garment-bags, rarely fit into the overhead compartment of an airplane; and when they do, tend to allow for the suit to be crushed by other luggage placed on top of the bag.

(c) All currently available garment-bags, were created with maximum capacity as their object; thus placing a valuable suit on par with a pair of socks.

(d) When completely filled and closed (transport mode), all presently available garment-bags measure between 7 and 12 inches in thickness, which can create serious storage problems on-board aircraft.

(e) Visually, almost all garment-bags are very ugly, and have very few smooth lines, which would make them as appealing as an artists portfolio looks.

(f) Nearly all available garment-bags lack a comprehensive hanging-system for the garments themselves, and tend to rely on the traveler providing their own clumsy hangers; which seldom match in shape.

(g) No existing garment-bag closes in a lengthwise fashion, which is the natural means by which a suit is sewn.

OBJECTS AND ADVANTAGES

Several objects and advantages which the "SuitFolio" has over other garment-style bags are:

(a) to provide a means of transporting suits or dresses in a manner which does not wrinkle such garments in an unnatural fashion;

(b) to provide a visually-appealing shaped bag, which has smooth lines;

(c) to provide travelers with a garment-bag which can be easily stored in the overhead compartment of a plane;

(d) to provide a garment-bag which will be used to carry suits/dresses only and nothing else;

(e) to provide a garment-bag which has a built-in, hanger-system, which gives support to the garments in every situation encountered while traveling;

(f) to provide an adjustable hanger-system which can adjust size (in a slide-rule manner) to accommodate the various sizes suits and dresses come in;

(g) to provide a quality garment-bag for a moderate target price, comparable to the price of existing models.

Further objects and advantages are to provide a simple structured, garment-bag, which closes as an ordinary artist's portfolio, and allows for access to the garments contained, in a book-like fashion, whereby, each "Page" of the book, will contain a compartmentalized garment, contained in a light, mesh fabric, which covers the hanger-system (depicted in FIG. 6). Still further objects and advantages will become apparent from a consideration of the ensuing description and drawings, depicted in [FIG. 11 through FIG. 6].

DRAWING FIGURES

In the drawings, closely related figures have the same number but different alphabetic suffixes.

Figure 8:
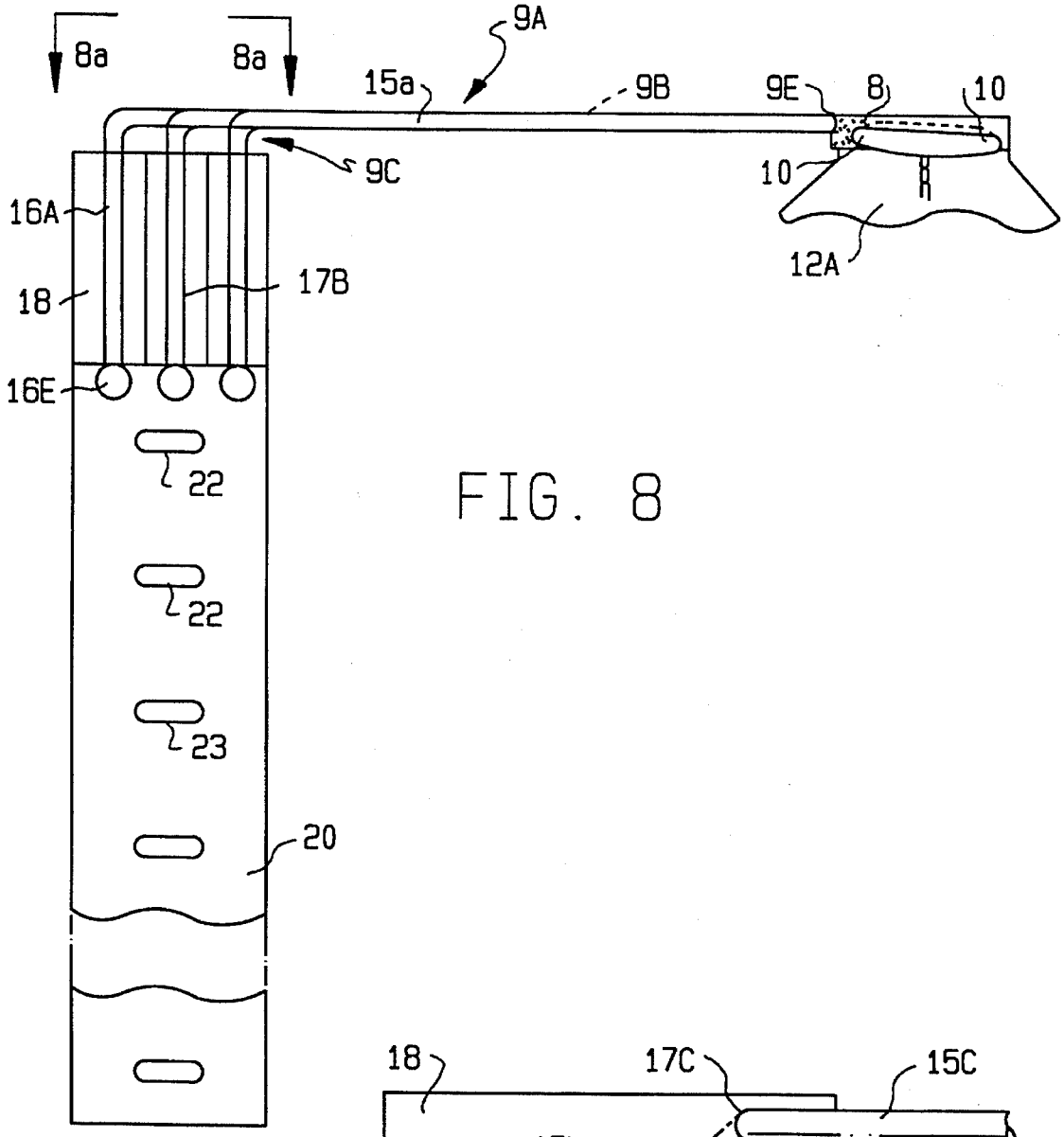
FIG. 8 is an enlarged plan view of the hanger and envelope bag pivot arrangement.
Figure 8A:
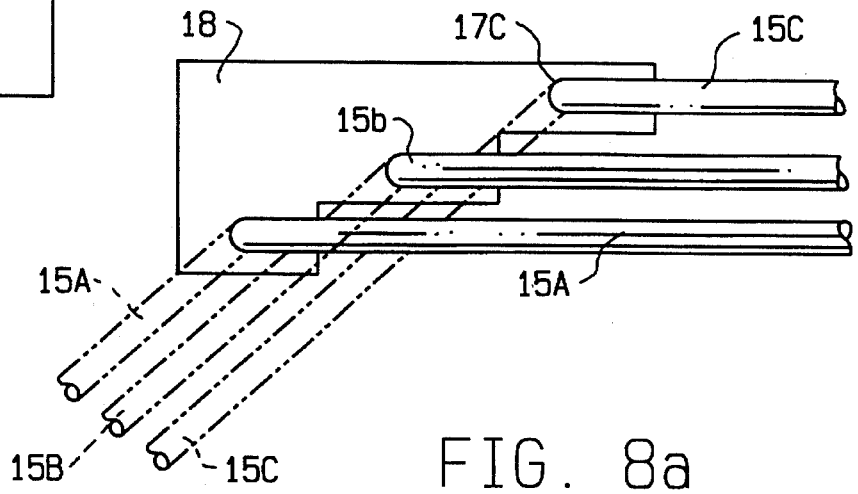
Figure 9:
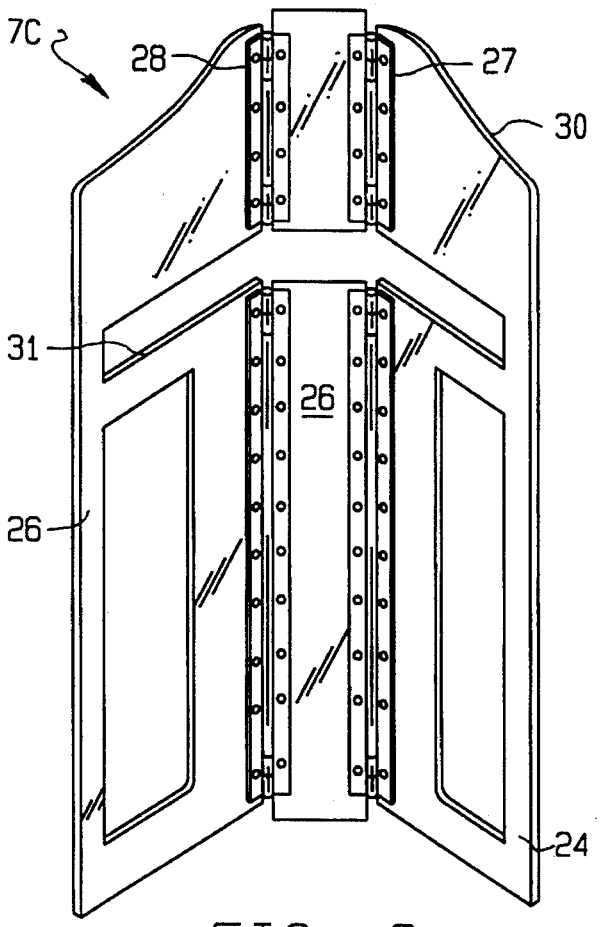
Figure 9A:
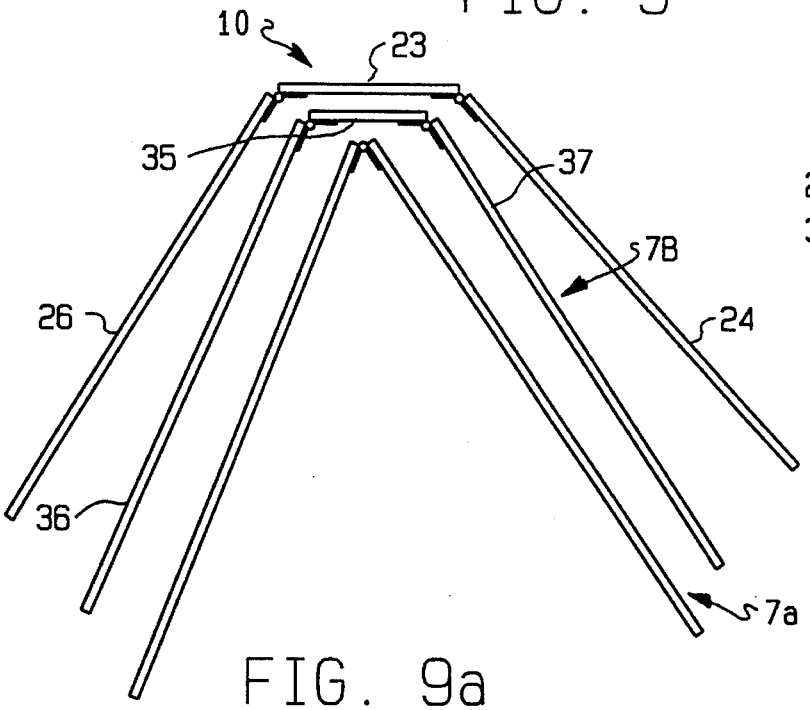
Figure 9B:
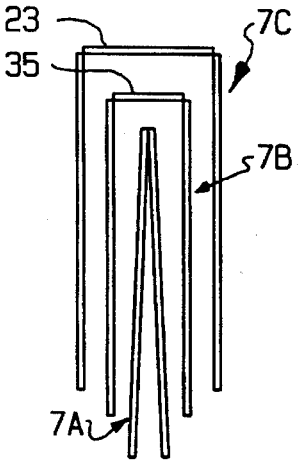
Figure 10:
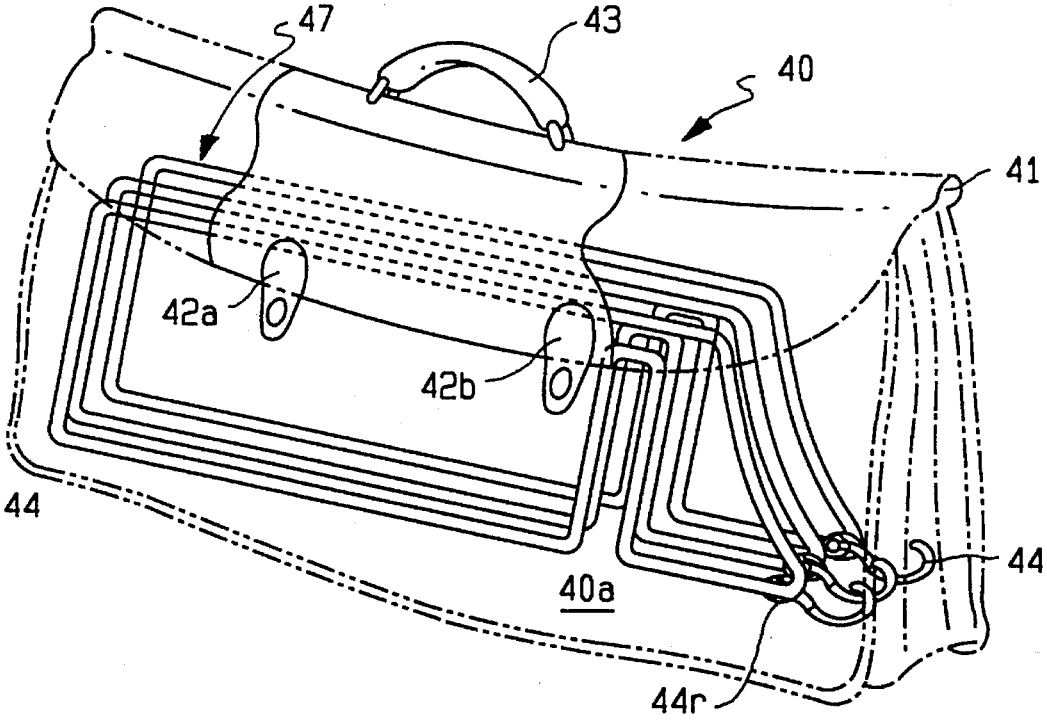
Figure 11:
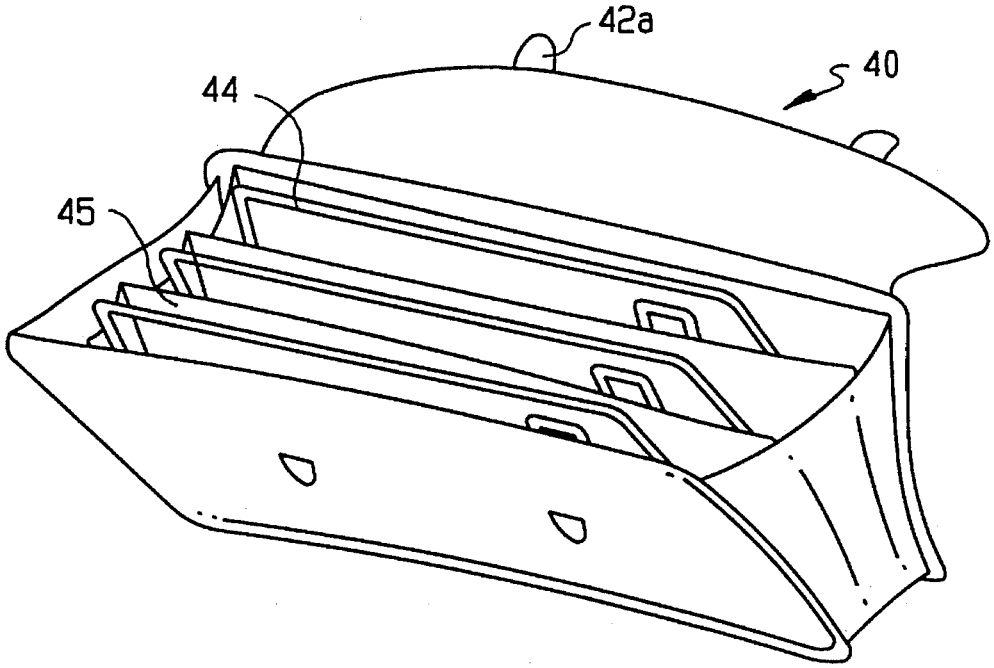

FIG. 8*a* is a partial end view taken along line 8—8 of FIG. 8;

FIG. 9 is a perspective view of a hanger in partially folded position;

FIG. 9*a* is a top view of the nest of three (3) hangers partially opened;

FIG. 9*b* is a top view of FIG. 9*a* with the hangers closed;

FIG. 10 is a perspective view of a further embodiment of hangers and a case of the present invention with only one-half of each hanger shown (for simplicity of drawing) positioned in an opaque closed case which appears for illustrative purposes only to be transparent;

FIG. 11 is a perspective view of the case open and showing internal folded hangers, again with only one-half of each hanger shown;

FIG. 12 is an elevational view of the hanger with a multiple hinge arrangement;

FIG. 13 is a perspective of one of the elongated hinge clips shown in FIG. 12;

FIG. 14 is a plan view of the clip hinge of FIG. 13;

FIG. 15 is a sectional view showing the hinge clip engaged to the tubular portions of the hanger; and FIG. 16 is a view similar to FIG. 15 showing each of the two (2) tubular portions rotated about 90° with respect to the hinge.

REFERENCE CODES IN DRAWINGS

| | |
|---|---|
| 1A | Zipper |
| 1B | Carry-Handle |
| 1C | Outside Shell |
| 2A,3C | Inner Locking-Hinge |
| 2B,3A | Inner Mesh-Covering |
| 2C,5D | Spiral 'Page' Binding |
| 2D | Inside Hanging-Hook |
| 3B,4D | Inside Shell |
| 3D | Floating Hanger-System |
| 3E,6A | Hanger-Ring |
| 3F,4A,5C | 'Page-1' of SuitFolio (Front/Rear Views) |
| 4B,5B,5E | 'Page-2' of SuitFolio (Front/Rear Views) |
| 4C,5A | 'Page-3' of SuitFolio |
| 6B,6B1,6B2 | Pant-Rack (one per 'Page') |
| 6C | Folding Support-Bar |
| 6D | Bottom Reinforcement-Bar |
| 6E | Side Reinforcement-Bar(s) |
| 6F | Main Folding-Hanger |
| 6G | Various Sliding Adjustments For Hanger System |

Description-FIGS. 1 to 6

Figure 1:
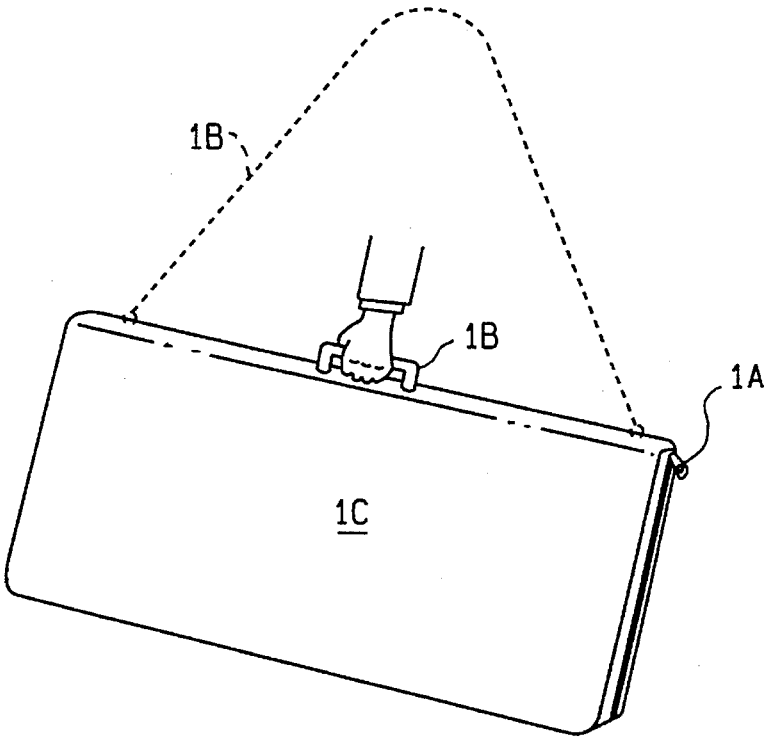
FIGS. 1A to 1C show the "SuitFolio" in its travel position.

A typical embodiment of the "SuitFolio" in its transport position, is illustrated in FIG. 1, which depicts the elongated shape of the Outside-Shell [1C] when completely closed with the surrounding Zipper [1A]; or the alternative method of employing belt-straps, as a typical means of closure for smaller portfolios, which would not affect the appearance or alter the overall-concept of, the "SuitFolio-" The soft-shelled handle [1B] allows for ease of transport between various destinations.

With the Zipper [1A] opened, the Hinges [2A;3C] located on opposite ends, are locked into the opened-position, the Spiral Binding [2C;5D] can be viewed along the edge of the Inside-Shell [3B;4D]. The thin Mesh Cover [2B;3A] acts as a additional protectant for the garments. 'Page-1' of the "SuitFolio" [3F] exhibits the front-view of the first garment as well as a partial view of the elongated, Floating Hanger-System [3D;FIG. 6]; which folds to accommodate for the overall shape and utility of the "SuitFolio."

Figure 6:
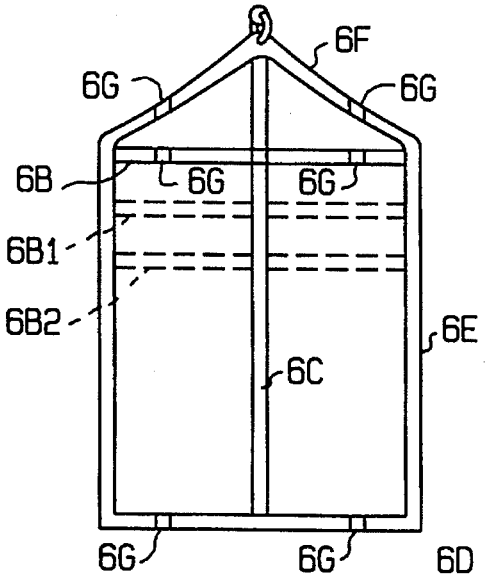
FIGS. 6A to 6G shows the hanger-system in detail, which will adjust in a slide rule manner at each of the intersection points on the flat-surfaced hanging-system (shown at each point labeled 6G), as well as a view of the hanging system in the folded position.
Figure 6A:
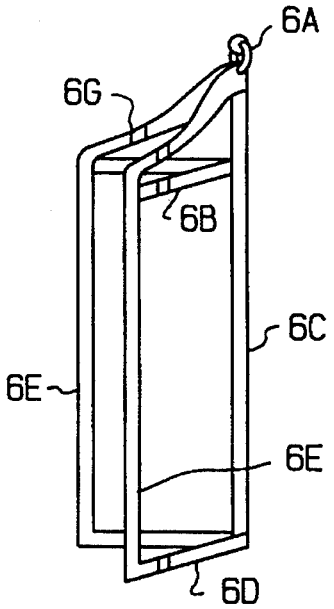

As with an ordinary book, each 'Page' [3F;4B;4C] can be viewed from both front and rear, depending upon its relative position to other 'Pages.' Each 'Page' will consist of a Floating Hanger-System [FIG. 6], permanently attached to a mesh/plastic cover (front and back) via the Hanger-Ring [3E]; somewhat resembling the appearance of a suit a person would carry home from their local drycleaner (upon a hanger, but covered in plastic wrapper).

The Hanger-System [FIG. 6] is constructed of flat brass or stainless-steel, which is strong, yet flexible- At the top, is the Hanger-Ring [6A] which is permanently attached to the mesh/plastic covering, and connects to the angular portion of the entire frame [6F]. In order to secure the garment, the Hanger-System [FIG. 6], has Side Reinforcement Bars [6E], as well as a Reinforcement-Bar across the bottom [6C]. To accommodate the various garment sizes available, the entire hanger-system [FIG. 6] has strategically located points of adjustment [6G], which facilitate the method of adjustment in a 'Slide-Rule' style; whereby one flat piece of brass lies on top of another, with both being held together by a clasp, thus allowing for the sliding operation of adjustment The center of the entire system is held together by a support bar [6C], which serves as a support vehicle for the garments, while in transport; so as to allow the garment to hang over the support-bar, once the "SuitFolio" is in the transport mode [See FIG. 1].

From the description above, a number of advantages of my "SuitFolio" become evident:

(a) The bulkiness of ordinary garment-bags is overcome, since the "SuitFolio" was created to fit in an overhead compartment of an airplane very easily, and measures approximately 4–5" thick; compared to 7–10" for ordinary garment bags.

(b) The appearance of the "SuitFolio" is very stylish, with smooth, clean-lines, resembling an artist's portfolio visually.

(c) The innovative (adjustable/folding) hanger-system, allows for minimum wrinkling of the garments, while facilitating complete support during transport-mode.

(d) The concentration upon containing and transporting suits or dresses only, highlights the importance such garments possess in a person's overall wardrobe.

(e) The book-like design of the page to cover (shell) relationship, maintains the simplicity of accessing each of the garments, in an efficient and uncomplicated manner.

(f) The overall simplicity and style of the "SuitFolio" would be a welcome innovation in the luggage category.

Operation-FIGS. 1, 2, 3, 4, 5, 6

The manner of using the "SuitFolio" resembles that of ordinary artists' portfolios in present use. Namely, the user would begin by unzipping the "SuitFolio" Zipper [IA], around the perimeter of the Outer-Shell [1C], as you would with an ordinary portfolio.

Figure 2:
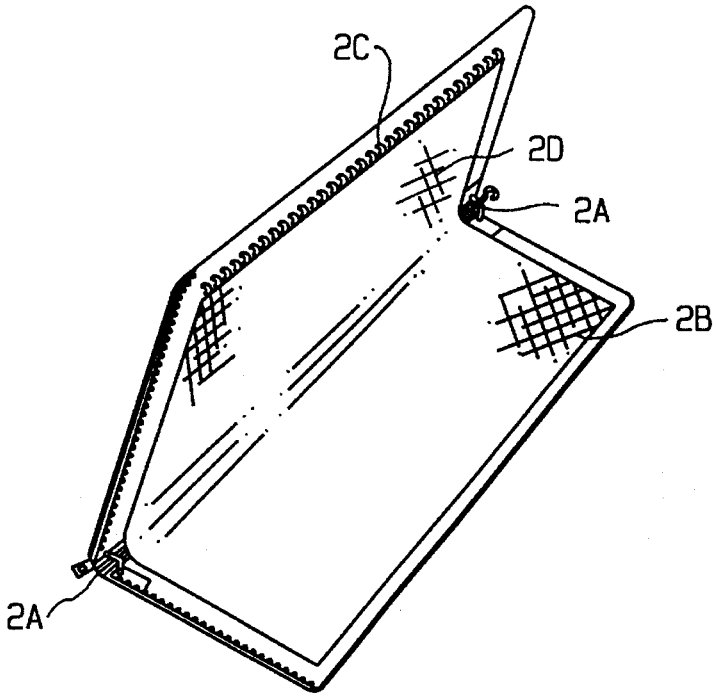
FIGS. 2A to 2C shows the "SuitFolio" in its partially opened position (for perspective)
Figure 3:
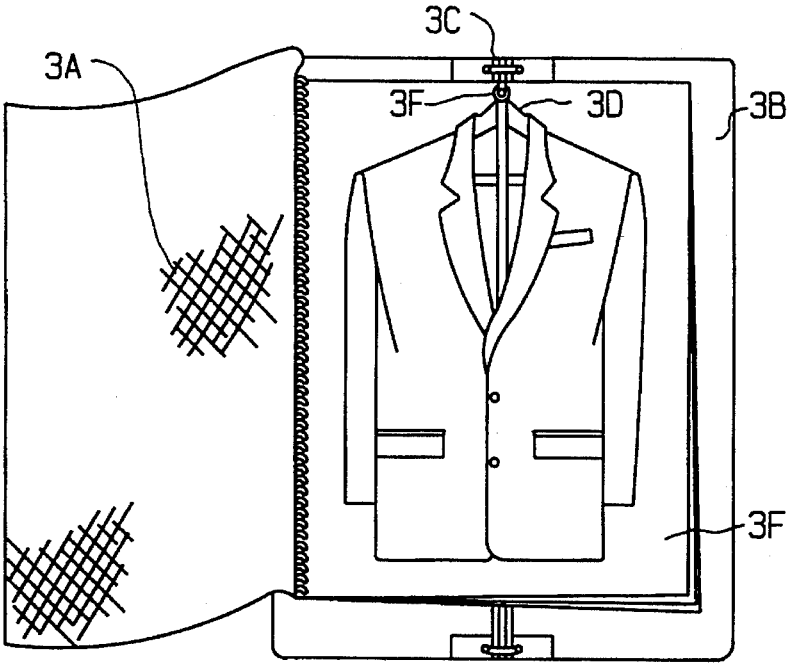
FIGS. 3A to 3E shows the "SuitFolio" in its locked position which allows for access to the garments, and depicts a partial view of the hanger system.
Figure 4:
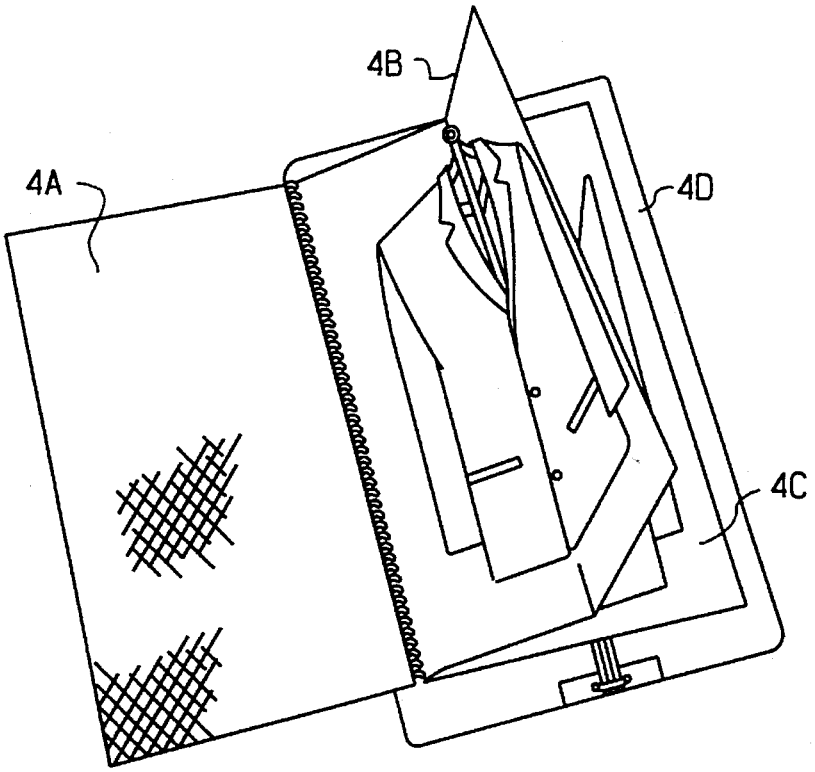
FIGS. 4A to 4D shows the "SuitFolio" subsequent to the first 'Page' (containing garment #1) folded over, allowing for access to 'Page 2' and 'Page 3'.
Figure 5:
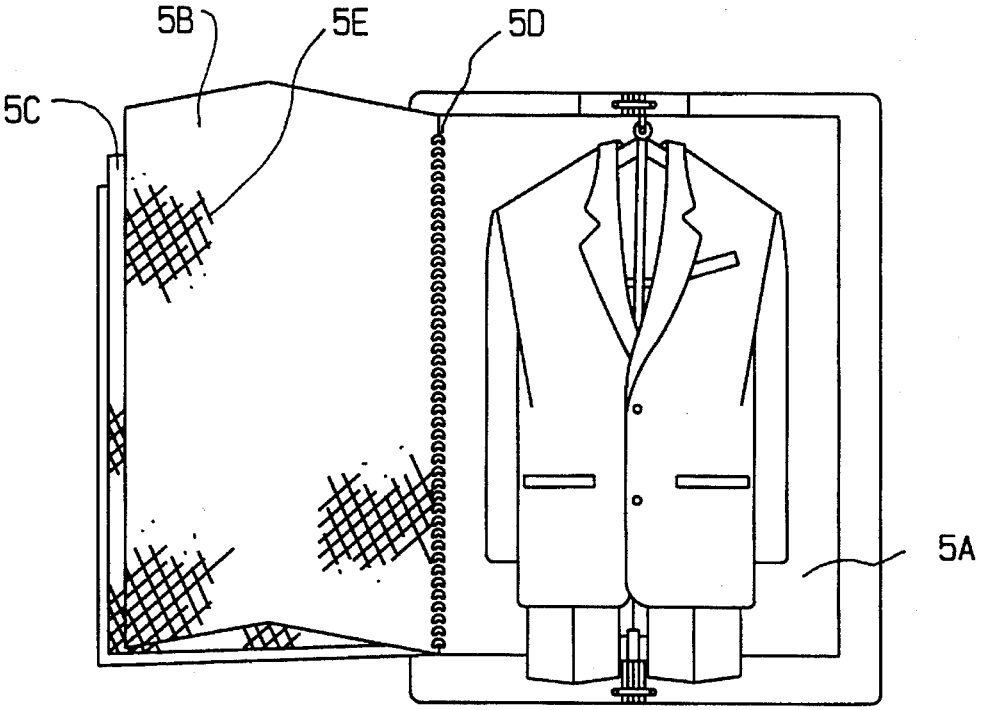
FIGS. 5A to 5E shows the "SuitFolio" subsequent to the second 'Page' (containing garment #2) folded over, allowing for access to 'Page 3'.

Upon opening the Outer-Shell [1C] in a clam-like fashion, the Hinges [2A] will lock into place, thereby maintaining the flattened, square-shape (FIG. 2). The clothing can the be either inserted or accessed by folding away the Mesh-Covering [2B;3A], and removing the hanger-system [3D] from its Mesh/Plastic 'Page' [3F], through an open slot located on the front of each 'page.'

In order to access the 2nd or 3rd 'Page,' the user would merely have to turn the preceding 'Page(s),' connected by the Spiral-Binder [2C;5D], just as you would turn the pages of an ordinary spiral notebook.

The process of placing the garment on the hanger-system [3D], would begin with the pants (in the case of a suit). The pants would be hung at the knees on the Pant-Rack [6B], with the belt of the pants located behind the Folding Support-Bar as you face the pants, the legs (bent at the knee) would be in your immediate view, and the bottom portion of the pants would be behind the legs, hanging upside-down.

Subsequently, the jacket to the suit would be hung in the ordinary manner, draped over the main hanger [6F]; thereby maintaining the shape of the suit, while allowing for a perfect longitudinal fold down the back-seam of the jacket, once closure of the "SuitFolio" is desired.

Final closure, would simply involve the restoration of each of the 'Pages' [3F;4B;4C] to their original position; lying flat against the inside-shell [3B], and covered by the mesh covering [3A]; Followed by unlocking of the hinges [2A], and the final lengthwise-closure (longitudinal) in a clam-like fashion-sealed with the zipper [1A] around the perimeter of the entire unit.

SUMMARY, RAMIFICATIONS, AND SCOPE

Accordingly, the reader will see that the "SuitFolio" has a design which is both functional and visually, appealing. The lack of bulkiness facilitates ease of transport, and in particular, is ideal for overhead storage on-board an airplane; which is very appealing to today's businessperson. Furthermore, the "SuitFolio" has the additional advantages in that;

>The natural means by which the garments fold, within the "SuitFolio," results in fewer wrinkled garments, once the final destination of a journey has been reached.

>It permits for a simplified means to carry several garments in a neat and easy format.

>It permits for ease of storage in either a vehicle, or an airplane's overhead storage-compartment.

>It provides a strong, yet lightweight method of storing and transporting the user's necessary garments, in both an efficient and attractive fashion.

>It is a serious alternative, garment-bag, for busy executives who rely on organization and function in their luggage and their lives.

Although the description above contains many specificities, these should not be construed as limiting the scope of this invention, but as merely providing illustrations of some of the presently preferred embodiments of this invention. For example, the Outside-Shell [1C] can have other shapes, such as oval, square, or even triangular. The Zipper [IA] could easily be replaced by simple belt-loops or the like, depending upon the desired appearance the user wishes to project. Finally, the Hanger-System [FIG. 6] could be less angled at the main Hanger [6F], or be made with rounded materials, rather than the flat stainless-steel proposed above.

Thus the scope of the "SuitFolio" should be determined by the appended claims and their legal equivalents, rather than by the examples given.

Figure 7:
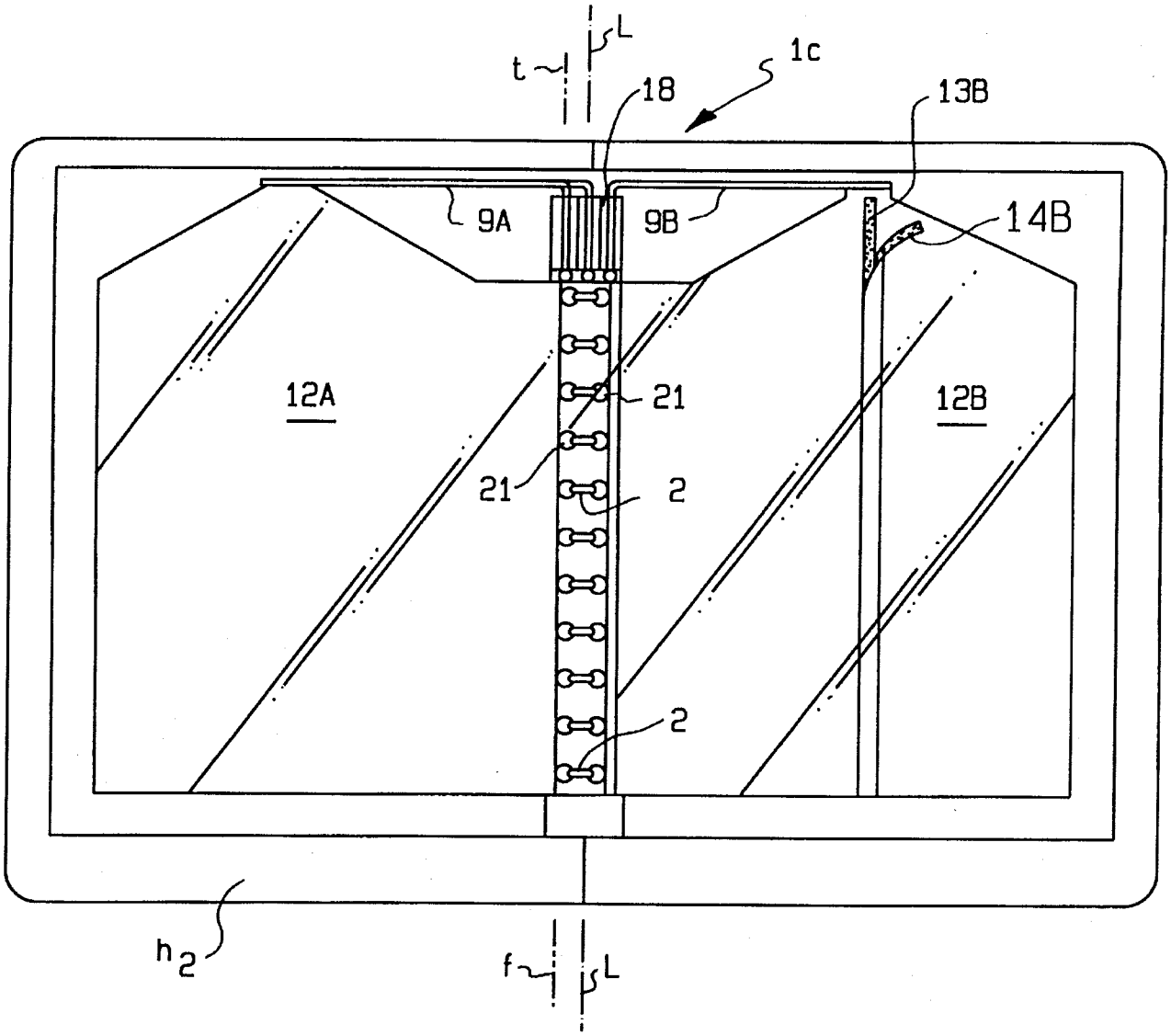
FIG. 7 is a plan view of an alternative embodiment in case open position lying upon a horizontal surface.

Turning to FIGS. 7, 8 and 9, there is shown an alternative embodiment of the foldable suit folio carrying case 1C' having two halves $h_1$, $h_2$ and fold area f. Case halves $h_1$ and $h_2$ are zippered together for carrying (see FIG. 1). Each suit is hung on a foldable hanger 7A, B and C. Each hanger 7A–C is attached, using cord 8, to swingable pivoted arm unit 9A–C, each unit having an arm slide piece 9E which pieces are slidable on their respective arms 15A–C. Arm slide pieces 9E have through holes 10 to permit hanger attachment using cord 8. Each hanger 7A–C is enclosed in a flexible transparent envelope bag 12A–C having a vertical opening 13A–C with strips of hook and loop material 14A–C for facile sealing and unsealing of bags 12A–C. A Velcro brand hook and loop material may be used. Suits can be readily placed on and removed from hangers 7A–C through openings 13A–C.

Arm units 9A–C, which may be made of any suitable material, include horizontal arms 15A–C and integral support pieces 16A–C. Support pieces 16A–C rotate about vertical axis in bearing slots 17A–C formed in mount block 18 (see FIGS. 8, 8*a*). Support pieces 16A–C have enlarged end bulbs 16E spaced below block 18 to permit pieces 16A–C to move up and down while remaining in slots 17A–C. Envelope bags 12A–C each have side ring holes 21 for mounting on half rings 22 mounted spaced-apart on base piece 20. Rings 22 are operable and closable using any conventional technique. Each bag 12A–C, along with its arm unit, 9A–C is turnable, in page fashion, from a position in suit folio case half $h_1$ to a position in case half $h_2$ for access to a selected bag 12A–C. The transparency of bags 12A–C allows the user to see the color or shape of the suit or other garment in the bag. Alternatively, bags 12A–C may be translucent or opaque.

Turning to FIG. 9, there is shown hanger 7C with central vertical spine 23, right hinged section 24 and left hinged section 26. Hinge 27 serves spine 23 and right section 26 and hinge 28 serves spine 23 and left section 26. Coat support portion 30 and pants support portion 31 are also shown.

Turning finally to FIG. 9*a*, a nest of hangers 7A–C is shown. Hanger 7B has a spine 35 having less width than spine 23 of hanger 7C, a left-hand section 36 and right-hand section 37. Hanger 7A has no spine. Hanger 7A–C nests readily and right and left-hand sections of hanger 7B and C may be positioned at right angles to their spines with hanger 7A folded closed. In FIG. 9*b*, hangers 7A–C are shown in their folded position when case 1C' is closed and zippered up for carrying.

The carrying case garment bags 1C, 1C' of the present invention have lengths and widths such that the bags are readily stored in the overhead bin of a jet plane. Lengths of between 16 inches and 28 inches and widths of between 30 and 40 inches are preferred.

A further embodiment of the present invention is shown in FIGS. 10–16, in which case 40 includes an expandable interior storage area 40*a*. Also shown are flexible case hinge 41, snap closures 42*a*, 42*b*, handle 43 and hanger hooks 44*h* with connector rings 44*r*. Three (3) folded hangers 47 are depicted in case 40 (with each hanger represented by one-half of a hanger 44 for drawing simplicity). In FIG. 11 case 40 is open with hangers 47 (again each represented by a single half 44) separated by dividers 45. Turning to FIGS. 12 and 13, four (4) hinges 50 are shown. Hanger hook 44*h* is attached to center section 51 of upper hanger 50 (see FIG. 12). This is an alternative to the use of a ring 44*r*.

As seen in FIG. 12, hanger 47 is comprised of two (2) halves 44 which halves can be carried separately or as engaged by one or more hinges 50 positioned along axis L. Half sections 44 carried separately are connected by hinges 50 when appropriate for use. Hangers 47 each include coat shoulder support frame portions 49*a*, 49*b* for supporting the upper portion of a coat, pants support surfaces 51*a*, 51*b*, side coat support portions 48*c*, 49*c* for supporting the lower portion of a coat and interior frame pieces 48*p*, 49*p*. Frame pieces 48*p*, 49*p* are tubular to permit proper swivel operation within hinges 50 and preferably all portions of hanger 47 are tubular in shape and integrally formed. Note side coat support portions 48*c*, 49*c* extend downwardly a sufficient distance to substantially support a coat. Preferably, support portions 48*c*, 49*c* support over at least 50% of the length of a suit jacket coat. Hanger halves 44 may be attached using other suitable hinge arrangement that allows a sufficient swivel so that halves 44 can be folded to positions whereby hanger half planes 48*s*, 49*s* formed by elements 49*a*, 49*b*, 48*c*, 49*c* and 48*p*, 49*p* are parallel or nearly parallel for storage in case 40 as shown in FIG. 10. The use of hinges 50 with center sections 51 permits halves 44 to be spaced apart after hanger folding to accommodate a garment thereon. Use of one or more hinges 50 provides, in effect, a three (3) piece hanger.

In FIGS. 13 and 14 hinge 50 is integrally formed with a center section 51 and two (2) adjacent tubular portions 52, 53. FIG. 15 shows frame portions 48*p*, 49*p* assembled into a hinge 50 with stops 55 on portions 48*p*, 49*p*. Portions 48*p*, 49*p* rotate about parallel axes A and B respectively. FIG. 16 shows that frame portion 49*p* has been rotated through angle a which is about 90°. Assembly can be accomplished by making the hinges 50 of plastic or other distortable material.

While hinged hanger 47 is a preferred embodiment, a three section hanger made of tubular portions similar to FIG. 9 may also be utilized.

I claim:

1. A garment case comprising (a) interior storage area in the case having longitudinal dimensions and width dimensions with the longitudinal dimensions being substantially greater than the width dimensions;

(b) at least one garment holding unit positioned in said storage area;

(c) each holding unit comprising at least two foldable sections which sections have longitudinal dimensions and width dimensions with the longitudinal dimensions being substantially greater than the width dimensions, which sections are foldably hinged together for foldable rotation about an axis lying in a section longitudinal dimension and each said foldable section adapted for receiving garments for hanging thereon and thereafter foldable about said axis for positioning in the case with the said axis parallel to a case longitudinal dimension;

(d) each said foldable section further including i) upper right and left coat first garment support portions to support by hanging the upper shoulder portion of a coat, one on each foldable section;

ii) lower coat side second support portions, one on each section; and iii) a further garment support portion for receiving an additional garment thereon which further garment support portion is intermediate to (1) the upper coat support portions and (2) the lower coat support portions; and (e) the holding unit fold axis being located such that right and left coat garment supports turn toward one another when the foldable sections are folded.

2. The garment hanger of claim 1 in which the holding units are comprised of tubular portions.

3. The garment hanger of claim 1 in which the foldable sections each include a center hinge portion and an adjacent portion.

4. The garment hanger of claim 1 in which two of the sections of the holding unit are pivotal about spaced-apart axes.

5. The garment hanger of claim 1 having in addition a coat garment in combination with said lower coat side support portions wherein such side support portions have sufficient lengths to support at least 50% of the length of said garment.

* * * * *